United States Patent [19]

Wicén

[11] Patent Number: 4,941,439

[45] Date of Patent: Jul. 17, 1990

[54] COMBUSTION CHAMBER SURFACES OF AN INTERNAL COMBUSTION ENGINE

[75] Inventor: Jan Wicén, Almunge, Sweden

[73] Assignee: Oktan AB, Stockholm, Sweden

[21] Appl. No.: 424,277

[22] PCT Filed: May 5, 1988

[86] PCT No.: PCT/SE88/00235

§ 371 Date: Oct. 23, 1989

§ 102(e) Date: Oct. 23, 1989

[87] PCT Pub. No.: WO88/08926

PCT Pub. Date: Nov. 17, 1988

[30] Foreign Application Priority Data

May 8, 1987 [SE] Sweden ..... 8701913

[51] Int. Cl.[5] ..... F02B 77/02

[52] U.S. Cl. ..... 123/193 P; 123/669; 428/215

[58] Field of Search ..... 123/193 C, 668, 669; 428/215, 472

[56] References Cited

U.S. PATENT DOCUMENTS

| | | | |
|---|---|---|---|
| 3,459,167 | 8/1969 | Briggs et al. | 123/669 |
| 3,552,370 | 2/1969 | Briggs | 123/669 |
| 4,254,621 | 3/1981 | Nagumo | 123/669 |
| 4,471,017 | 9/1984 | Poeschel et al. | 428/215 |
| 4,523,554 | 6/1985 | Ryu | 123/193 C |
| 4,538,562 | 9/1985 | Matsui et al. | 123/669 |
| 4,776,309 | 10/1988 | Wicén | 123/669 |

FOREIGN PATENT DOCUMENTS

| | | |
|---|---|---|
| 0075228 | 9/1982 | European Pat. Off. . |
| 1055292 | 4/1959 | Fed. Rep. of Germany . |
| 521519 | 5/1972 | Switzerland . |

*Primary Examiner*—E. Rollins Cross

*Attorney, Agent, or Firm*—Frishauf, Holtz, Goodman & Woodward

[57] ABSTRACT

An arrangement in combustion chamber surfaces of an internal combustion engine, wherein these surfaces exhibit at least partially a thin surface layer (2) which will influence the octane/cetane rating requirement of the engine in a manner to limit the knocking tendency of the engine. The surface layer (2) comprises a material of low reflectivity and high absorptivity in respect of electromagnetic waves having a wavelength of up to at least 7 μm. The surace layer (2) has located therebeneath a layer (3) which functions as a transient heat buffer and alternately absorbs heat from and emits heat to the surface layer (2).

12 Claims, 1 Drawing Sheet

COMBUSTION CHAMBER SURFACES OF AN INTERNAL COMBUSTION ENGINE

BACKGROUND OF THE INVENTION

The present invention relates to an arrangement of the combustion chamber surfaces of an internal combustion engine, in which these surfaces exhibit at least partially a thin surface layer which will influence the octane/cetane rating requirement of the engine so as to limit the knocking tendency of the engine. An arrangement of this kind is proposed in Swedish Patent Specification No. 85 05 302-3, this known arrangement being characterized in that when at least a part of the walls of combustion chamber are treated in the manner prescribed, the walls will absorb 90–95% of all thermal radiation in the energy-rich wave length range of interest for influencing engine combustion. Furthermore, since the radiation which is reflected into the combustion chamber is diffuse, radiation from the walls of the combustion chamber contributes towards the occurrence of knocking in the combustion process to only a very slight extent.

As the energy-rich radiation is absorbed into the combustion chamber walls it converts, however, to so-called joule's heat within the thin layer of material, which is therewith heated rapidly to such high temperatures as to eventually form a so-called "hot spot" during the combustion process, which initiates knocking. Some of this radiation is also reflected back into the combustion chamber as a result of the high surface temperatures that prevail, resulting in heat loss.

The object of the present invention is to provide an improved arrangement of the aforesaid kind in which the aforementioned drawbacks are fully or partially eliminated.

SUMMARY OF THE INVENTION

The invention is mainly characterized in that a heat buffer which has a special function is provided beneath said surface layer, and in that the nature of this surface layer is such that during combustion the layer is able to "capture" the energy-rich radiation and later, when the temperature of the combustion chamber has fallen to a level beneath the level of the layer temperature, to emit radiation effectively to the combustion chamber. The aforesaid special function of the heat buffer is to accumulate heat rapidly from the surface layer when the layer receives heat from the combustion chamber, while at the same time cooling said surface layer, i.e. the heat buffer must be capable of rapidly leading away heat and have a given thermal capacity. Subsequent hereto, it shall be possible to utilize as much of the stored heat as is possible, to heat the surface layer upon the termination of the combustion process. Cooling of the surface layer during the process of combustion counteracts knocking, while subsequent heating of said surface layer and the radiation of heat to the combustion chamber maintains the temperature level during expansion of the cumbustion gases, so as to obtain an improvement in efficiency. The simplest way of achieving such a transient heat buffer is to incorporate beneath the surface layer a layer of copper or silver having a thickness of about 1 mm.

These metals conduct heat very rapidly, which is the most important property expected of a good transient heat-buffer, i.e. there should be chosen a material which has a high value of thermal diffusivity according to the formula:

$$D = \frac{\lambda}{\rho \times c}$$

where $\lambda$ = thermal conductivity, $\rho$ = density, and c = specific heat capacity.

In order to utilize the material in the heat buffer to the best extent and to reduce the loss of heat therefrom to the engine cooling channels, the underlying layer is preferably arranged on a heat insulating layer, e.g. a thin layer of nickel.

DETAILED DESCRIPTION

Figure 1:
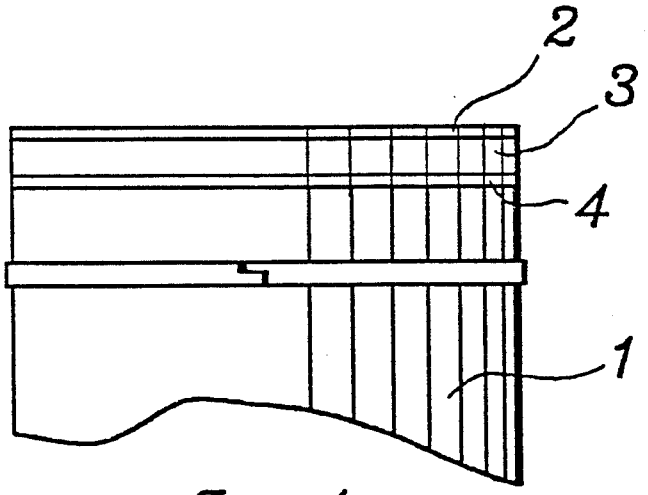
FIG. 1 is a side view of the top of a piston according to one example of the invention.

FIG. 1 illustrates the upper part of a piston 1 belonging to an internal combustion engine. The piston may be one which has been cast from a suitable aluminium alloy in accordance with conventional techniques. In accordance with the invention, the illustrated upper piston part incorporates a surface layer 2 of black chromium (chromium oxides and chromium) having a thickness of about 4 $\mu$m, and a thicker copper layer 3. The copper layer has a thickness of about 1 mm and is situated on a thin layer of nickel 4, which forms a heat insulating layer.

The layers are conveniently applied electrolytically, subsequent to sand blasting the underlying surfaces. The copper layer 3 may be made slightly thinner, particularly when it is situated on a nickel layer 4.

Figure 2:
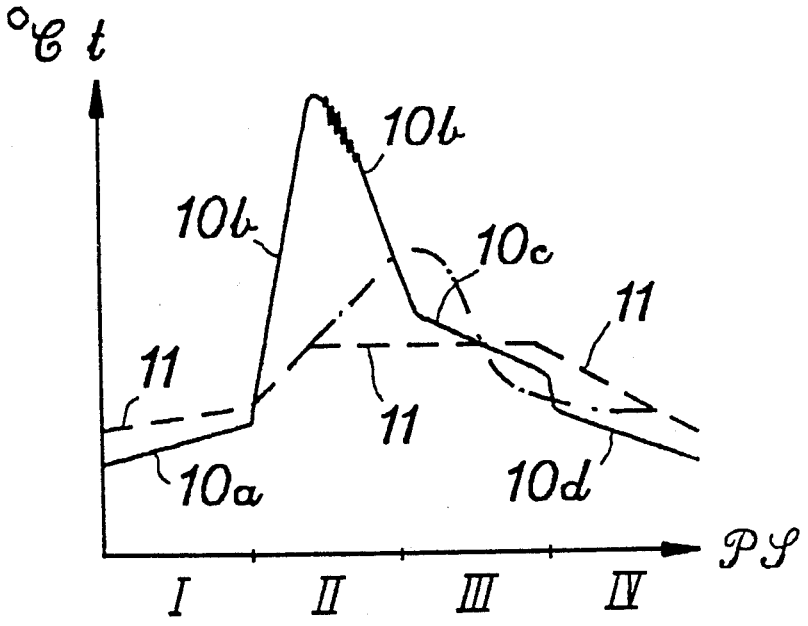
FIG. 2 is a diagram which illustrates temperature curves for two points in an internal combustion engine during a combustion cycle.

The effect of the arrangement of the present invention on the temperature conditions t in a combustion chamber during the different working strokes (PS), compression I, expansion/combustion II, exhaust III, and suction IV, is illustrated diagrammatically in FIG. 2. The full line 10 in FIG. 2 indicates very schematically how the temperature varies in the combustion chamber during a combustion cycle. Thus, it is shown that the temperature will first rise slowly during the compression stroke **10*a* and then rapidly to a peak value during the combustion 10*b*. The temperature will then fall rapidly during the final part of the combustion process 10*b* and then at a slower rate during the exhaust stroke 10*c* and suction stroke 10*d***.

The broken line curve 11 indicates the temperature of the surface layer 2 and varies in time with the curve 10, although it has other amplitudes. The surprising and significant fact about the curve 11 is that the rise in temperature during the combustion process is interrupted and that the temperature remains constant during a large part of the combustion process and the exhaust stroke. In the case of a conventional piston, the temperature would follow the course of the chain line shown in FIG. 2. This is because the copper layer 3 located beneath the surface layer 2 stores heat from the surface layer during the combustion process, therewith cooling said surface layer, and delivers stored heat to the surface layer 2 upon completion of the combustion process, therewith heating the surface layer 2 so as to maintain or sustain the combustion chamber temperature during the expansion of the combustion gases, during which the temperature decreases, thereby maintaining the pressure level and consequently also the engine torque in a more effective manner than was previously the case. The emission properties of a conventional piston are inferior under such conditions. The fact that the surface layer 2 is heated by the underlying layer in this way upon completion of the combustion process probably explains the reason for the marked reduction in carbon deposits observed when comparing an engine which incorporated the inventive arrangement with an engine which did not.

This comparison also showed that the emission of hydrocarbons was about 30% lower in the engine which incorporated the inventive arrangement, which was surprising.

As will be understood, materials other than chromium oxide can be used in the surface layer 2, for instance so-called cermet material, as described in Swedish Patent Application No. 85 05 302-3, or quite generally such metal oxides as those used as selective absorber layers in solar energy collectors.

Furthermore, the cylinder head and valves may also be prepared in accordance with the invention, either in addition to the piston head or alternatively thereto.

The arrangement of the invention is intended primarily for Otto-cycle engines, but may also be incorporated in diesel engines, since it dampens knocking in such engines quite considerably.

I claim:

1. An arrangement in combustion chamber surfaces of an internal combustion engine, comprising:

a thin surface layer provided at least partially on the combustion chamber surfaces of the engine, and which will influence the octane/cetane rating requirement of the engine in a manner to limit the knocking tendency of the engine;

said thin surface layer (2) comprising a material of low reflectivity and high absorptivity in respect of electromagnetic waves having a wavelength of up to at least 7 μm, and high emissivity at wavelengths longer than 7 μm; and a further layer (3) located beneath said thin surface layer (2) for accumulating heat given off by said thin surface layer (2) during a process of fuel combustion in the engine so as to counteract a rise in temperature of said thin surface layer (2) and to heat said thin surface layer (2) during a part of the combustion cycle in which the temperature in the combustion chamber is lower that the temperature of said thin surface layer (2).

2. The arrangement of claim 1, further comprising a heat insulating layer (4) underlying said further layer (3).

3. The arrangement of claim 2, wherein said heat insulating layer (4) is a thin layer of nickel.

4. The arrangement of claim 1, wherein:

said thin surface layer (2) comprises black chromium and has a thickness of about 4 μm; and said further layer (3) comprises copper and has a thickness of about 1 mm.

5. The arrangement of claim 4, further comprising a heat insulating layer (4) underlying said further layer (3).

6. The arrangement of claim 5, wherein said heat insulating layer (4) is a thin layer of nickel.

7. The arrangement of claim 1, wherein:

said thin surface layer (2) comprises black chromium and has a thickness of about 4 μm; and said further layer (3) comprises silver and has a thickness of about 1 mm.

8. The arrangement of claim 7, further comprising a heat insulating layer (4) underlying said further layer (3).

9. The arrangement of claim 8, wherein said heat insulating layer (4) is a thin layer of nickel.

10. The arrangement of claim 1, wherein said further layer (3) is thicker than said thin surface layer (2).

11. The arrangement of claim 4, wherein said further layer (3) is thicker than said thin surface layer (2).

12. The arrangement of claim 7, wherein said further layer (3) is thicker than said thin surface layer (2).

* * * * *